US006315537B1

(12) United States Patent
Helbing et al.

(10) Patent No.: US 6,315,537 B1
(45) Date of Patent: Nov. 13, 2001

(54) SPIN PUMP HAVING A COOLING SLEEVE SURROUNDING THE DRIVE SHAFT

(75) Inventors: Ulrich Helbing, Burscheid; Egon Gathmann, Remscheid; Thomas Krämer, Burscheid; Jürgen Hasenburg, Radevormwald, all of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/618,931

(22) Filed: Jul. 18, 2000

Related U.S. Application Data

(63) Continuation of application No. PCT/EP99/09383, filed on Dec. 1, 1999.

(30) Foreign Application Priority Data

Dec. 4, 1998 (DE) ..... 198 55 943

(51) Int. Cl.[7] ..... F04C 2/20; F04C 11/00; F04C 15/00

(52) U.S. Cl. ..... 418/101; 418/102; 418/196; 418/384; 418/900

(58) Field of Search ..... 418/101, 102, 418/196; 384/900

(56) References Cited

U.S. PATENT DOCUMENTS

| | | | | |
|---|---|---|---|---|
| 2,699,122 | * | 1/1955 | Erickson | 418/196 |
| 4,060,353 | * | 11/1977 | Akimoto et al. | 418/102 |
| 4,336,213 | * | 6/1982 | Fox | 418/102 |
| 4,471,963 | | 9/1984 | Airhart | 277/1 |
| 4,735,262 | * | 4/1988 | Lucas | 384/900 |
| 5,462,420 | | 10/1995 | Stehr et al. | 418/83 |
| 5,637,331 | | 6/1997 | Lenk et al. | 425/206 |
| 5,924,854 | * | 7/1999 | Blume et al. | 418/102 |

FOREIGN PATENT DOCUMENTS

| | | | |
|---|---|---|---|
| 24 44 843 | | 4/1975 | (DE) . |
| 149 834 A2 | | 7/1985 | (EP) . |
| 0 189 670 B1 | | 8/1986 | (EP) . |
| 602 357 A1 | | 6/1994 | (EP) . |
| 0 636 190 B1 | | 2/1995 | (EP) . |
| 4-164180 | * | 6/1992 | (JP) ..... 418/102 |
| 10-131872 | | 5/1998 | (JP) . |
| WO94/19516 | | 9/1994 | (WO) . |

* cited by examiner

*Primary Examiner*—John J. Vrablik
(74) *Attorney, Agent, or Firm*—Alston & Bird LLP

(57) ABSTRACT

The invention relates to a spin pump for conveying a liquid polymer melt. To drive the conveying means enclosed in the pump housing, a drive shaft is provided, which extends through the pump housing in a bearing bore, and which comprises an external end for connecting to a drive. To seal the outward extending drive shaft, a cooling sleeve is employed which connects in a pressure tight fashion to the pump housing. The cooling sleeve surrounds the drive shaft with a narrow gap therebetween, and the outer surface of the cooling sleeve is cooled by a coolant for increasing the viscosity of the polymer melt which enters the gap between the drive shaft and the cooling sleeve. With an increased viscosity, the melt acts to seal the gap without interfering with the rotation of the drive shaft.

17 Claims, 4 Drawing Sheets

SPIN PUMP HAVING A COOLING SLEEVE SURROUNDING THE DRIVE SHAFT

CROSS-REFERENCE TO RELATED APPLICATION

The present application is a continuation of international application No. PCT/EP99/09383, filed Dec. 1, 1999 and designating the U.S.

BACKGROUND OF THE INVENTION

The invention relates to a spin pump for conveying a liquid polymer melt.

In the spinning of synthetic yarns, a polymer melt is supplied by a spin pump to a spinneret and extruded. Such a spin pump is known, for example, from EP 0636190 and corresponding U.S. Pat. No. 5,637,331. In this spin pump, individual pumps advance the polymer melt from an inlet channel to one or more outlet channels. The individual pumps are driven by a common drive shaft which extends outside of the pump housing. For the power transmission, the drive shaft is supported in a bearing bore of the pump housing and possesses an external end for coupling to the drive. This arrangement makes it necessary to seal the gap that is formed between the drive shaft and the pump housing, while taking into account that the polymer melt has a temperature of more than 200° C. To ensure a uniform temperature as well as viscosity of the melt, the pump housing may be heated. However, such high demands cannot be met by conventional seals.

In the case of the pump known from EP 0189670, it is proposed to form a seal by means of a conveying screw thread. In particular, a section of the drive shaft is provided with a spiral flute. The threaded section of the drive shaft extends through a bushing that is joined to the pump housing by flanges. In the case of this seal, the rotation of the drive shaft generates a conveying effect in the sealing gap, which returns the polymer melt to the interior of the pump. Due to the low drive speeds in the range of at most 100 rpm, the spin pumps reach only a very low peripheral speed on the drive shaft. This generates a small conveying effect, and the sealing of the gap remains inadequate.

EP 0602357 discloses a pump, wherein the conveying screw thread is provided in a bushing, through which the drive shaft extends. The bushing is inserted into a housing cover. Likewise in this arrangement, the sealing effect is dependent on the peripheral speed of the drive shaft. To this extent, this seal is unsuited for low rotational speeds. For tempering the bushing, the housing cover accommodates a channel system, through which a cooling medium flows. However, this arrangement has the disadvantage of an additional tempering device inside the pump housing as well as a high coolant consumption that is thereby necessitated.

It is therefore an object of the invention to provide a spin pump for conveying a liquid polymer melt of the initially described type with a shaft seal, which operates uniformly and is in particular independent of the drive speed.

A further object of the invention is to provide a sealing system, which does not require a cooling by a separately supplied coolant.

SUMMARY OF THE INVENTION

The above and other objects and advantages are achieved by the provision of a pump which comprises a housing having a melt inlet and a melt outlet, and conveying means such as intermeshing gears for conveying a liquid polymer melt from the melt inlet to the melt outlet. The conveying means includes a drive shaft which extends through a bearing bore in the housing and which includes an external end for connection to a drive. A cooling sleeve is tightly mounted to the housing so as to coaxially surround the portion of the external end of the drive shaft which is adjacent the housing so as to form a narrow annular gap therebetween which communicates with the bearing bore.

The invention as described above is characterized by a selfsealing effect. In this connection, the conveyed polymer melt serves as a sealing material which enters into the sealing gap. The invention is based on the knowledge that the polymer melt becomes more viscose as its temperature drops, and even solidifies at a certain temperature. Thus, it is possible to influence by a tempering of the polymer melt in the sealing gap the flow properties of the polymer in the sealing gap and to adapt it to the sealing requirements. For tempering the polymer melt in the sealing gap, the drive shaft extends through the cooling sleeve of a cooling body. To this end, the cooling body connects in a pressure tight fashion to the pump housing. Between the drive shaft and the cooling sleeve the narrow annular gap is formed. For tempering the polymer melt, the outer surface of the cooling sleeve is cooled by a coolant, preferably a cooling air. This causes the polymer to solidify or thicken, at least in a subsection of the gap, and leads to a sealing effect. A further advantage of the invention lies in that the tempering of the polymer melt occurs outside of the pump housing, which is usually heated. To this extent, there exists no significant influence of the tempering of the melt inside the pump housing. In addition, the solidified or highly viscose polymer results in no significant frictional losses of the drive shaft.

It has been shown that in proportion to the diameter of the drive shaft, a length of the cooling sleeve of at least 1.0 times the diameter of the drive shaft permits realizing an adequate solidification for sealing the gap. Preferably, the cooling sleeve is made with a minimum length of 1.5 times the diameter of the drive shaft.

A cooling rib, or a plurality of cooling ribs, are preferably mounted to the exterior of the cooling sleeve. By this construction, the cooling effect of the cooling sleeve increases substantially. In this connection, it is possible to arrange the cooling ribs so as to be oriented in the axial direction, or in the radial direction of the cooling sleeve, for the transfer of heat.

In the case of vertically arranged drive shafts, an annular cooling rib may be configured to include a circumferential collar. This renders it possible to collect polymer particles that may exit from the end of the cooling sleeve, in the event of a vertical arrangement of the drive shaft.

To influence the amount of heat that is removed from the cooling sleeve, a particularly preferred embodiment of the invention provides that the cooling ribs are designed and constructed for adjustment on the circumference of the cooling sleeve. Thus, it is possible to cool subsections in the axial direction of the cooling sleeve differently.

To intensify the cooling, at least one cooling rib may be arranged on the circumference of the drive shaft, outside of the cooling sleeve. The rib thus rotates at the speed of the drive shaft, so as to generate an air turbulence. This air turbulence leads to an intensive heat exchange on the surface of the cooling sleeve, so that the heat can rapidly dissipate in the sealing gap between the drive shaft and the cooling sleeve.

To support the sealing effect, a further development of the invention provides a conveying screw thread, which returns the polymer melt to the interior of the pump during the rotation of the drive shaft.

The conveying screw thread is arranged at least in one subsection in the cooling sleeve or in the drive shaft. Preferably, the subsection is located in the region in which the polymer has not yet undergone a substantial solidification, so that it is possible to return to the pump interior only liquid polymer. However, it is also possible to arrange a conveying screw thread over the entire length of the cooling sleeve.

To achieve a reduced pressure in the sealing gap between the drive shaft and the cooling sleeve, the sealing gap may be connected upstream of or at the beginning of the cooling sleeve to the inlet channel by means of a connection, for example, a bypass channel.

The conveying means of the spin pump may be in the form of pistons, blades, vanes, or similar parts. Especially advantageous is the construction of conveying means in the form of intermeshing gears. Such gear pumps are characterized in particular by an even volume flow.

To distribute, besides the conveying, the polymer melt evenly to a plurality of outlet channels, the pump may take the form of a multiple gear pump composed of a sun gear and multiple planetary gears, with the sun gear forming an individual pump with each planetary gear.

BRIEF DESCRIPTION OF THE DRAWINGS

In the following, some embodiments are described in greater detail with reference to the attached Figures, in which.

DETAILED DESCRIPTION OF THE PREFERRED EMBODIMENTS

Figure 1:
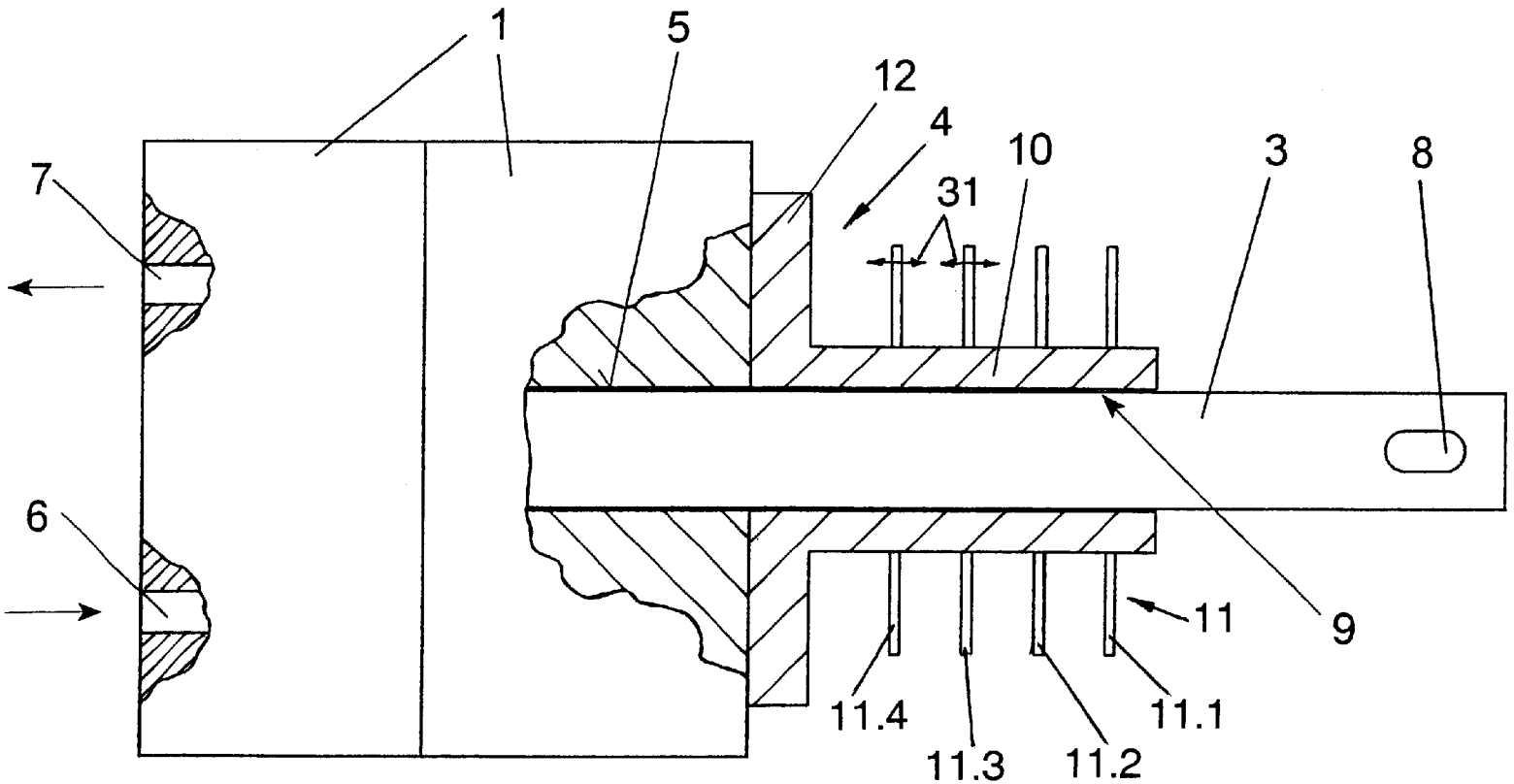
FIG. 1 is a schematic view of a first embodiment of a melt spin pump according to the invention.

FIG. 1 illustrates a first embodiment of a spin pump according to the invention. The spin pump includes a multipart pump housing 1, which is assembled together. Enclosed in the pump housing 1 are conveying means (not shown), which connect to a melt inlet channel 6 and a melt outlet channel 7. In this arrangement, the operation of the conveying means causes a polymer melt supplied via inlet channel 6 to flow under pressure into the outlet channel 7. The conveying means may be constructed as gears, pistons, vanes, or other known means. To operate the conveying means, a drive shaft 3 is used. The drive shaft 3 comprises an external drive end that connects via a coupling groove 8 to a drive (not shown). In the pump housing 1, the drive shaft is supported in a bearing bore 5. Outside the pump housing 1, the drive shaft 3 extends through a cooling body 4. To this end, the cooling body 4 comprises a cooling sleeve 10 that surrounds the drive shaft 3 outside the pump housing 1 with a narrow gap 9 therebetween. The cooling body 4 is tightly connected to the pump housing 1 via a flange 12, for example by means of a screw connection. The cooling body 4 comprises a plurality of cooling ribs 11, namely ribs 11.1, 11.2, 11.3, and 11.4, which are arranged for a transfer of heat on the circumference of cooling sleeve 10. The cooling ribs 11 radially surround the cooling sleeve 10. While cooling ribs 11.1 and 11.2 are stationarily secured to the cooling sleeve 10, cooling ribs 11.3 and 11.4 may be arranged for axial displacement along the cooling sleeve 10, as indicated schematically by the double arrows 31 in FIG. 1, and so that the cooling sleeve can be divided into zones for controlling the cooling.

The configuration and arrangement of the cooling ribs 11 on the cooling sleeve of the spin pump shown in FIG. 1 are exemplary. Thus, it is possible to arrange all cooling ribs stationarily on the cooling sleeve. Likewise, it is possible that the cooling ribs 11.1 and 11.2, which are provided toward the end of the cooling sleeve on the outlet side of the drive shaft 3, are displaceable, and that the cooling ribs 11.3 and 11.4 are stationary. However, it is also possible that all cooling ribs are constructed for displacement on the cooling sleeve.

In the case of the spin pump shown in FIG. 1, the drive shaft 3 is connected to the conveying means and, thus, via gaps, to the chamber of the pump. In operation, the polymer melt that is supplied to the spin pump via inlet channel 6, is delivered under pressure to one or more spinnerets. The operating pressure ranges preferably from 50 to 500 bars. Based on the high pressures, the liquid polymer melt enters the bearing gaps formed between the drive shaft 3 and the bearing bore 5. The polymer melt advances to the end of bearing bore 5 and enters the gap 9 between the cooling sleeve 10 and the drive shaft 3. The cooling body 4 connects via flange 12 to the pump housing 1 such that no melt is able to enter the joint between the flange 5 and the pump housing 1.

At the end of the bearing bore, the polymer melt is approximately at its operating temperature, since the pump housing 1 is tempered for a uniform flow of the melt. When the polymer melt enters the gap 9, a cooling occurs, so that as movement continues, the viscosity changes until the melt solidifies. The solidified or highly viscose melt leads at the end of the cooling sleeve 10 in sealing gap 9 to a sealing plug, which prevents or minimizes an exit of the melt at the end of cooling sleeve 10. The surface of cooling sleeve 10 as well as the surface of the cooling ribs 11 are surrounded by ambient air and, thus, dissipate the heat by convection. For purposes of increasing the cooling effect, it is also possible to increase the surface of the cooling sleeve 10 and the cooling ribs 11 by an active flow of a cooling medium, such as, for example, blown air.

The embodiment of the spin pump according to the invention has also the special advantage that the cooling body 4 does not influence a heat insulation of the pump housing 1. Thus, it is possible to insert the pump housing, for example, into a heating box, so that the cooling body and the drive shaft remain outside of the heating box.

Figure 2:
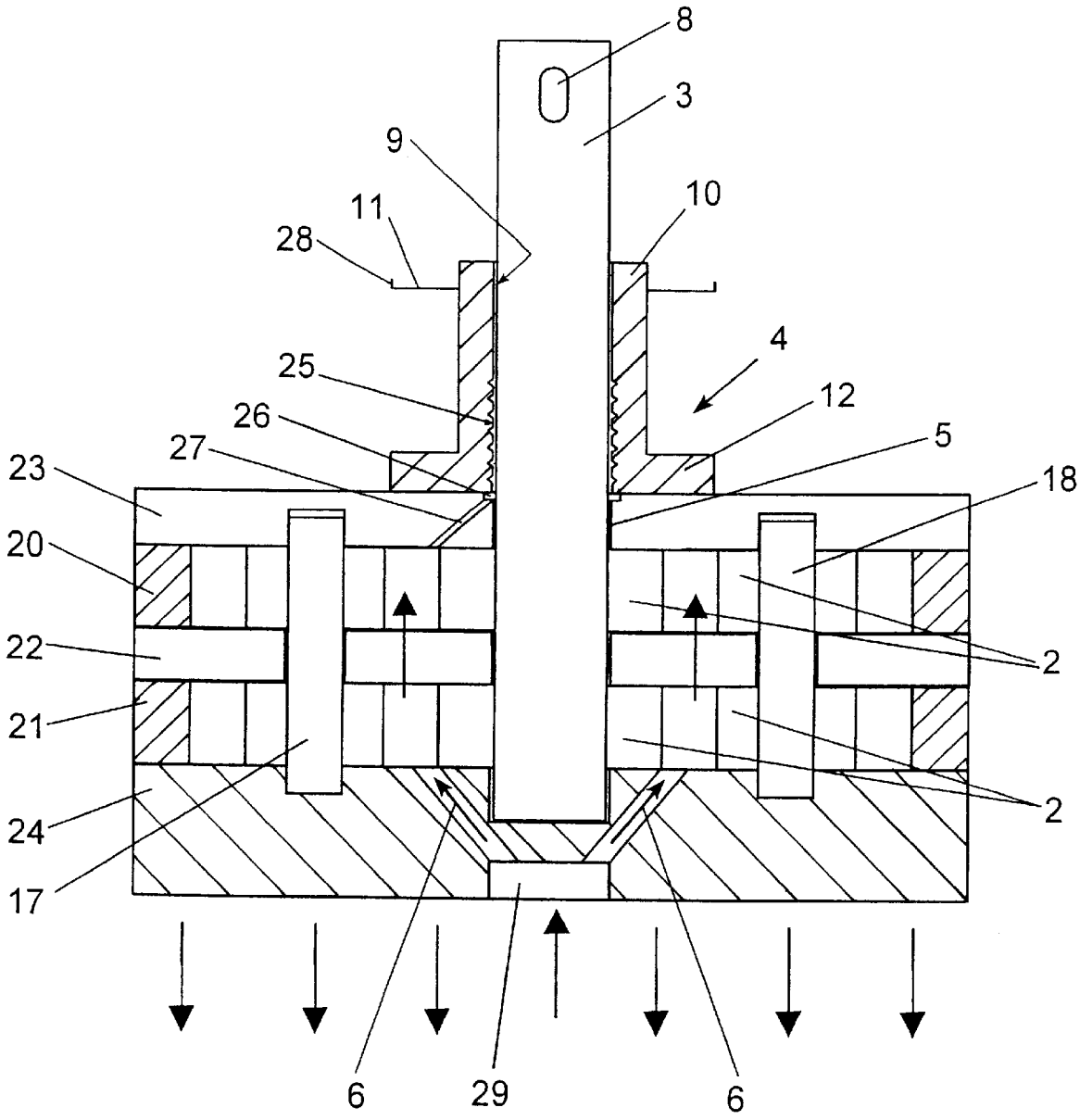
FIGS. 2 and 3 are a schematic view of a further embodiment of a spin pump according to the invention.
Figure 3:
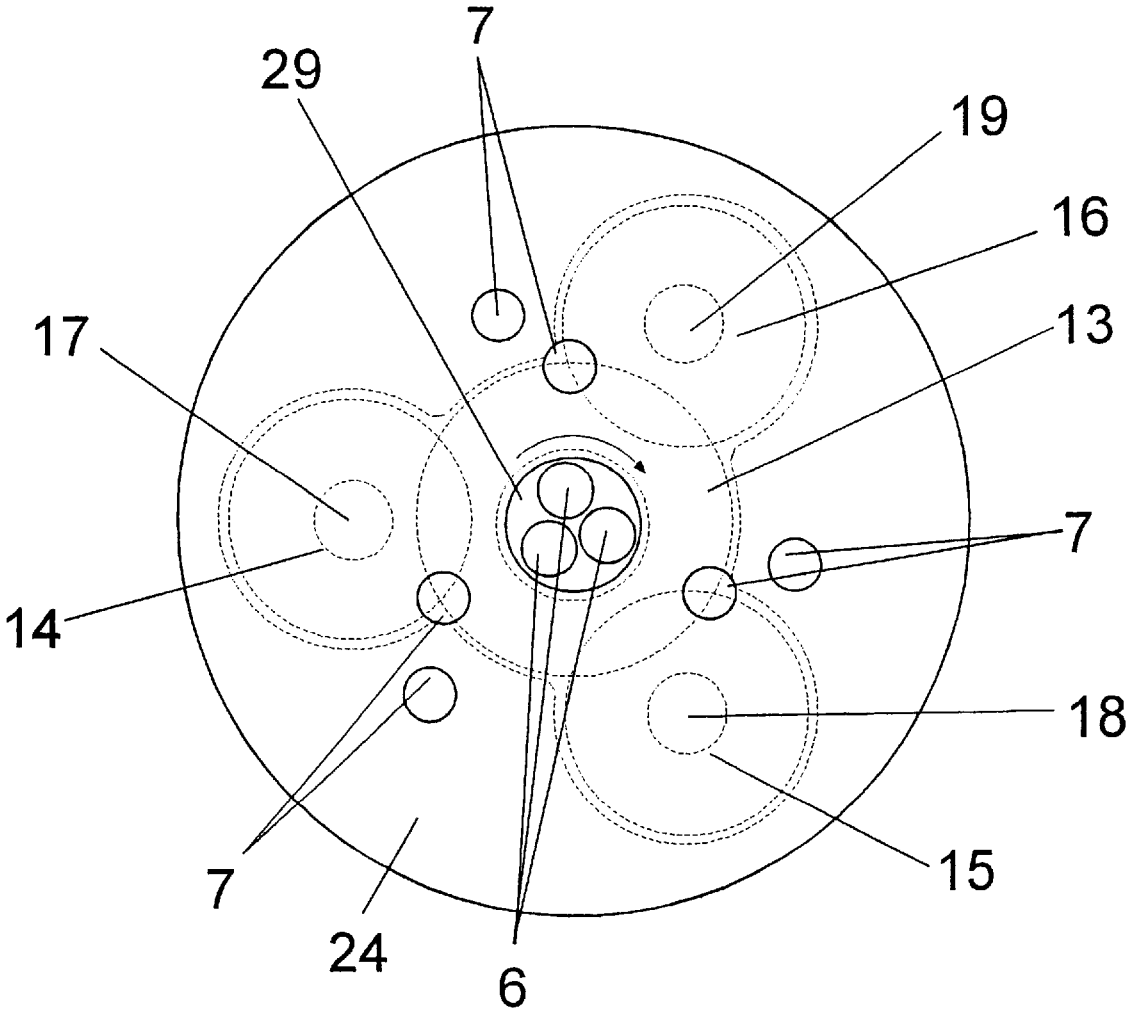

FIGS. 2 and 3 illustrate a further embodiment of a spin pump according to the invention. FIG. 2 is a schematic sectional view of the spin pump, and FIG. 3 a schematic top view of the spin pump. The following description thus applies to FIGS. 2 and 3. Structural parts of the same function are therefore provided with identical numerals.

In this case, the spin pump is a distributor pump. The conveying means 2 of the distributor pump are each designed and constructed as a set of gears. To this end, a sun gear 13 connects to the drive shaft 3. The sun gear 13 meshes with three planetary gears 14, 15, and 16. The planetary gears 14, 15, and 16 are arranged on the circumference, each 120° out of phase. The planetary gears 14, 15, and 16 are supported for free rotation about shafts 17, 18, and 19. This arrangement results in three paired gears, each consisting of the sun gear 13 and one of the planetary gears 14, 15, and 16. Each of these paired gears forms an individual pump.

Thus, the spin pump shown in FIG. 2 is a six-gear pump, inasmuch as common drive shaft 3 drives a second set of gears, which consists likewise of a sun gear as well as the planetary gears. For the sake of clarity it should be noted that corresponding sets of gears are supported coaxially. For receiving the sets of gears, the housing of the spin pump is formed by a plurality of joined plates. In this assembly, housing plates 20 and 21 support the two gear sets. The housing plates 20 and 21 comprise cutouts, which accommodate each the sun gear and the planetary gears. The two gears sets are separated from each other by an intermediate plate 22. The gear sets are closed, each on their end side by cover plates 23 and 24.

The drive shaft 3 is supported in the cover plate 24 and in the cover plate 23. In this arrangement, a bearing bore 5 extends through the cover plate 23, so that the drive shaft has an external drive end. The drive end comprises a coupling groove 8 for connecting to a drive. On the drive side of the spin pump, a cooling body 4 is flanged to the cover plate 23. The cooling body 4 comprises a cooling sleeve 10, through which the drive shaft 3 extends. To secure the cooling body 4 to the cover plate 23, a flange 12 is used. Between the drive shaft 3 and the cooling sleeve 10, a gap 9 is formed. On the pump side of cooling body 4, the gap 9 is widened by a conveying screw thread 25 arranged inside the cooling sleeve. To this end, the conveying screw thread 25 comprises a spiraling groove.

The free end of cooling sleeve 10 mounts a cooling rib on its circumference. The cooling rib 11 encloses the circumference of cooling sleeve 10 in the shape of a rim. At the free end of the cooling rib 11, a collar 28 projecting toward the drive side connects to the cooling rib 11 and surrounds it. Thus, the cooling rib 11 assumes at the same time the function of a collection container for receiving exiting melt particles—as is shown in FIG. 2 for a vertical drive.

The bearing bore 5 in the cover plate 23 is widened on the drive side thereof by an annular chamber 26. The annular chamber 26 connects via a bypass channel 27 to the pump inlet.

Opposite to the drive side of the spin pump, the cover plate 24 accommodates a central inlet chamber 29. From the inlet chamber 29, a plurality of inlet channels 6 lead to the respective pairs of gears. Each pair of gears connects to an outlet channel 7 arranged in the cover plate 24.

In the spin pump illustrated in FIGS. 2 and 3, a sealing occurs between the drive shaft 3 and the cooling body 4 by the solidification of the polymer melt that has entered the gap. The function has previously been described with reference to the embodiment of FIG. 1, so that at this point the foregoing description is herewith incorporated by reference. In comparison with the embodiment of the spin pump shown in FIG. 1, the spin pump of FIG. 2 includes a conveying screw thread 25 arranged in the cooling sleeve 10. The conveying screw thread is formed by a spiraling groove in the interior of cooling sleeve 10. The pitch of the conveying screw thread is formed such that during the rotation of drive shaft 3, the melt that has entered into the gap 9 is returned to the interior of the pump. The conveying screw thread screw 25 extends only over a subsection of cooling sleeve 10. At the free end of cooling sleeve 10, at which the solidified or highly viscose polymer melt forms a sealing plug, the melt is no longer returned. Thus, the liquid polymer melt that has entered into the sealing gap 9, is returned in part to the bearing bore. In the separating joint between the flange 12 and cover plate 23, the bearing bore 5 is widened by an annular chamber 26. The annular chamber 26 receives the returned polymer melt and guides the melt via bypass channel 27 to the pump inlet. As a result of this configuration, a reduced pressure prevails in the gap 9, which assists in cooperation with the conveying screw thread the sealing effect of the cooling body.

Figure 4:
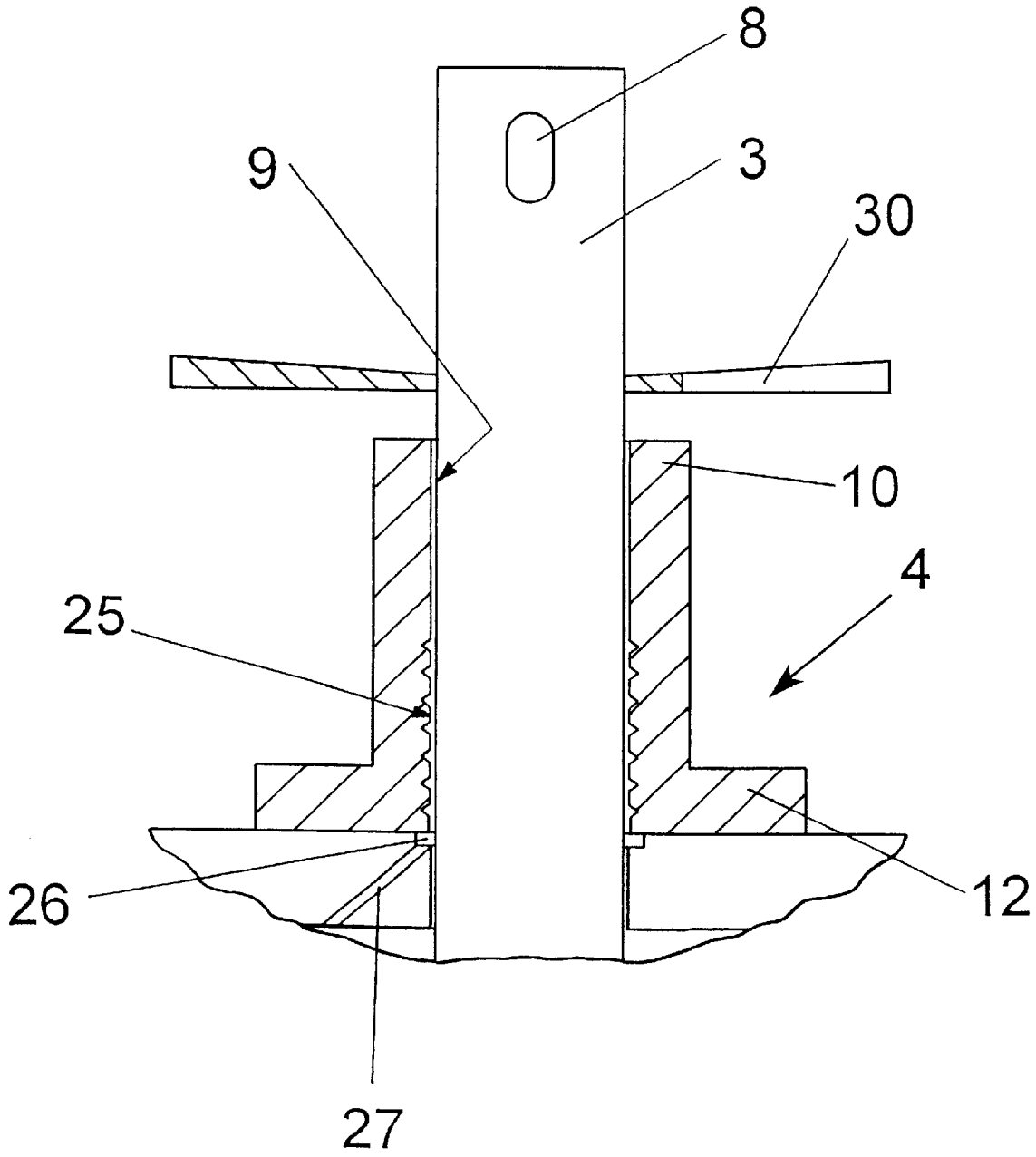
FIG. 4 is a schematic, partially sectioned view of a further embodiment a spin pump.

FIG. 4 illustrates a further embodiment, which includes a modification of the drive end of the spin pump and which can be combined with a spin pump of FIG. 1 or FIG. 2.

The cooling body 4 is identical to the cooling body shown in FIG. 2. Insofar the description of FIG. 2 is herewith incorporated by reference. However, in the present embodiment, the cooling body 4 has no cooling ribs on the circumference of cooling sleeve 10. At the end of cooling sleeve 10, the drive shaft 3 mounts on its circumference a cooling rib 30. The cooling rib 30 is rigidly secured to the drive shaft 3, so that it rotates at the speed of the drive shaft 3. Preferably, the cooling rib 30 is made segmental, so as to generate an air turbulence or air flow during the rotation of drive shaft 3. The air flow leads to an improved heat exchange between the cooling body 4, in particular the cooling sleeve 10 and the ambient air. For example, the cooling rib 30 may also be a fan wheel or an impeller wheel. With that, it is possible to generate purposeful air flows in direction of the cooling body.

In the described embodiments, the construction of the cooling body as well as its connection to the pump housing is exemplary. It is also possible that the pump housing and the cooling body are made in one part. It is likewise possible to construct the cooling body without cooling ribs. The cooling ribs may be made segmental or even extend in axial direction.

That which is claimed:

1. A pump for conveying a liquid polymer melt comprising:

a pump housing having a melt inlet and a melt outlet, conveying means mounted in the housing for conveying a liquid polymer melt from said melt inlet to said melt outlet, said conveying means including a drive shaft which extends through a bearing bore in said housing and which includes an external end for connection to a drive, and a cooling sleeve tightly mounted to the pump housing and coaxially surrounding the portion of the external end of the drive shaft which is adjacent said housing so as to form a narrow annular gap therebetween which communicates with said bearing bore, and the cooling sleeve defines a free end spaced from the housing, and with the cooling sleeve having at least one annular cooling rib mounted adjacent said free end of the cooling sleeve with the annular cooling rib being configured to retain any melt which leaks through said narrow annular gap.

2. The pump as defined in claim 1 wherein the cooling sleeve has an axial length which at least equals the diameter of the drive shaft.

3. The pump as defined in claim 2 wherein the one cooling rib includes an annular collar so that the cooling rib forms a receptacle adapted to retain any melt which leaks through said annular gap.

4. The pump as defined in claim 2 wherein the cooling sleeve has an internal bore, and wherein one of the drive shaft and the internal bore includes a helical groove which is configured to advance the melt in the gap back toward the bearing bore during operative rotation of the drive shaft.

5. The pump as defined in claim 2 wherein the cooling sleeve has an internal bore which includes a helical groove which is configured to advance the melt in the gap back toward the bearing bore during operative rotation of the drive shaft.

6. The pump as defined in claim 2 wherein the conveying means comprises at least one pair of meshing gears.

7. The pump as defined in claim 2 wherein a plurality of annular cooling ribs are mounted to the exterior of the sleeve in an axially spaced apart arrangement.

8. The pump as defined in claim 7 wherein at least one of said annular ribs is mounted to the exterior of the sleeve so as to be axially adjustable.

9. The pump as defined in claim 2 wherein a pressure relieving connection extends through the housing from the bearing bore to the melt inlet.

10. The pump as defined in claim 9 further comprising an annular chamber formed in one of the pump housing and the cooling sleeve adjacent the juncture of the bearing bore and the annular gap, and with said annular chamber communicating with said pressure relieving connection.

11. A multiple gear pump for distributing a melt flow of a liquid polymer melt received from a pressurized melt line, comprising a pump housing, a plurality of planetary gears mounted on respective planetary shafts within the pump housing, a drive shaft mounting a sun gear within the pump housing which is in operative engagement with each of said planetary gears so as to form a plurality of distributor gear pumps, a plurality of distribution channels extending from a melt inlet in the housing to respective distributor gear pumps, a plurality of outlet channels extending from respective distributor gear pumps to respective melt outlets in the housing, said drive shaft extending through a bearing bore in said housing and including an external end for connection to a drive, and a cooling sleeve tightly mounted to the pump housing and coaxially surrounding the portion of the external end of the drive shaft which is adjacent said housing so as to form a narrow annular gap therebetween which communicates with said bearing bore, and the cooling sleeve defines a free end spaced from the housing, and with the cooling sleeve having a heat dissipating annular rib mounted adjacent said free end of the cooling sleeve, with the heat dissipating annular rib being configured to retain any melt which leaks through said narrow annular gap.

12. The pump is defined in claim 11 wherein the heat dissipating rib includes an annular collar so that the rib forms a receptacle adapted to retain any melt which leaks through the annular gap.

13. The multiple gear pump as defined in claim 11 wherein the cooling sleeve has an axial length which at least equals the diameter of said drive shaft.

14. The pump as defined in claim 13 wherein a plurality of heat dissipating annular ribs are mounted to the exterior of the cooling sleeve in an axially spaced apart arrangement.

15. The pump as defined in claim 14 wherein the cooling sleeve has an internal bore, and wherein one of the drive shaft and the internal bore includes a helical groove which is configured to advance the melt in the gap back toward the bearing bore during operative rotation of the drive shaft.

16. The pump as defined in claim 15 wherein a pressure relieving connection extends through the housing from the bearing bore to the melt inlet.

17. The pump as defined in claim 16 further comprising an annular chamber formed in one of the pump housing and the cooling sleeve adjacent the juncture of the bearing bore and the annular gap, and with said annular chamber communicating with said pressure relieving connection.

* * * * *